United States Patent [19]

Sterk

[11] Patent Number: 4,989,550

[45] **Date of Patent: * Feb. 5, 1991**

[54] STEAM GENERATOR

[75] Inventor: Zvonimir Sterk, Erlangen, Fed. Rep. of Germany

[73] Assignee: Siemens Aktiengesellschaft, Munich, Fed. Rep. of Germany

[ * ] Notice: The portion of the term of this patent subsequent to Nov. 28, 2006 has been disclaimed.

[21] Appl. No.: 429,848

[22] Filed: Oct. 31, 1989

Related U.S. Application Data

[63] Continuation of Ser. No. 269,236, Nov. 9, 1988, Pat. No. 4,883,036.

[30] Foreign Application Priority Data

Nov. 11, 1987 [DE] Fed. Rep. of Germany ..... 3738347

[51] Int. Cl.[5] ..... F22B 37/48

[52] U.S. Cl. ..... 122/383; 122/381; 122/382

[58] Field of Search ..... 122/32, 381, 382, 383, 122/384, 386

[56] References Cited

U.S. PATENT DOCUMENTS

| | | | |
|---|---|---|---|
| 3,942,481 | 3/1976 | Bennett | 122/382 X |
| 4,200,061 | 4/1980 | Sterk et al. | 122/32 |
| 4,653,435 | 3/1987 | Lebouc | 122/382 |
| 4,756,770 | 7/1988 | Weems et al. | 122/383 X |

FOREIGN PATENT DOCUMENTS

| | | |
|---|---|---|
| 2523874 | 7/1976 | Fed. Rep. of Germany . |
| 2949975 | 4/1987 | Fed. Rep. of Germany . |

*Primary Examiner*—Edward G. Favors

*Attorney, Agent, or Firm*—Herbert L. Lerner; Laurence A. Greenberg

[57] ABSTRACT

A steam generator includes a vertically elongated housing. A horizontal tube plate and a U-shaped tube bundle are disposed in the housing. The tube bundle has mutually spaced apart legs defining an intermediate space therebetween and tube ends disposed in the tube plate. The tube plate has a horizontal blow-down line formed therein. The tube plate has holes formed therein leading from the blow-down line into the intermediate space.

6 Claims, 2 Drawing Sheets

STEAM GENERATOR

Figure 1:
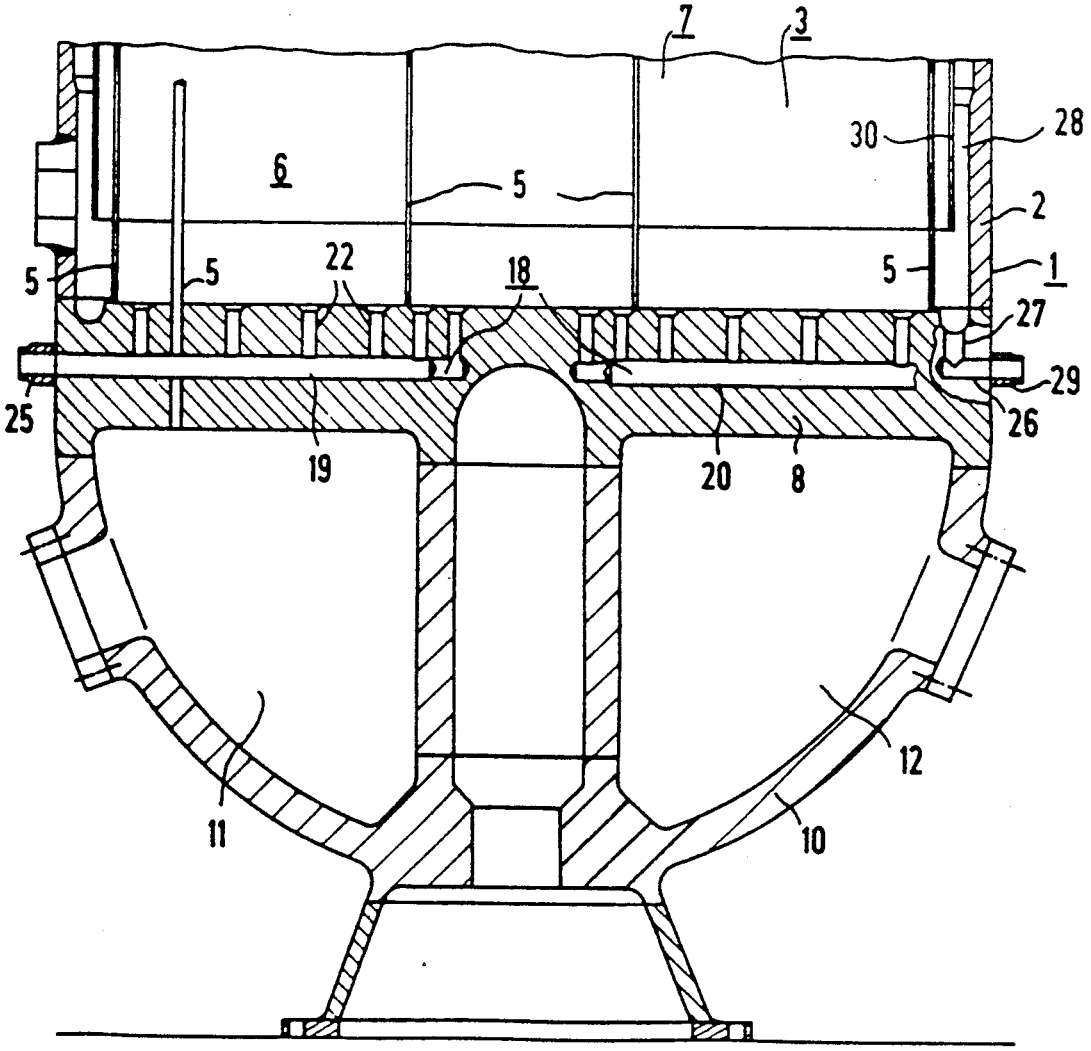

This is a continuation of application Ser. No. 269,236, filed Nov. 9, 1988, now U.S. Pat. No. 4,883,036.

The invention relates to a steam generator having a housing which is elongated in the vertical direction and which includes a U-shaped tube bundle with legs and tube ends disposed in a horizontal tube plate, and a blow-down line at the tube plate with vertical bores leading into the vicinity of the tube bundle.

German Published, Prosecuted Application DE-AS 25 23 874 discloses a steam generator having a blow-down line which is a space between the tube plate and a so-called baffle plate spaced at a distance above the tube plate or sheet. Bores which are distributed over the entire housing cross section are provided in the baffle plate, so that the entire cross section of the U-shaped tube bundle is reached by the blow-down line. Due to the large cross section of this "blow-down line", partitioning plates originating in ray-like fashion at the center of the steam generator housing are provided in order to form sector-like partial lines. Each of the 12 partial lines is connected through a valve to a common ring line. This is intended to make the cleaning process more economical, because it allows a decision to be made as needed between an optimum in terms of cleaning action and economy in terms of cleaning fluid. However, the prerequisite is then a major structural expense.

It is accordingly an object of the invention to provide a steam generator, which overcomes the hereinaforementioned disadvantages of the heretofore-known devices of this general type and which provides sufficient blow-down with the minimum possible structural expense.

With the foregoing and other objects in view there is provided, in accordance with the invention, a steam generator, comprising a vertically elongated housing, a horizontal tube plate or sheet in the housing, and a U-shaped tube bundle in the housing, the tube bundle having mutually spaced apart legs defining an intermediate space therebetween and tube ends disposed in the tube plate, the tube plate having a horizontal blow-down line formed or machined therein over the width of the tube bundle, and the tube plate having vertical bores formed therein leading from the blow-down line into the intermediate space.

According to the invention, in contrast to the prior art, the blow-down line is itself machined into the tube plate or sheet, for example by a boring process, or in other words by metal-cutting deformation, so that no additional structural parts are needed. The expense required for machining is relatively low and it can also be accomplished in the course of retrofitting as needed.

The invention offers the great advantage of ensuring that the blow-down line cannot be endangered by thermal strains or the like. In each case, sufficient blow-down is obtained with substantially less structural expense than in the conventional steam generator. Even the blow-down line according to German Patent DE-PS 29 49 975 which leads into a steam generator in the form of an additional tube, requires greater expense, because the additional tube must be supported in a vibration-proof manner in the space between the tubes of the steam generator in the vicinity of the tube plate, yet strains caused by the fastening during thermal expansion must be prevented.

In accordance with another feature of the invention, the horizontal blow-down line includes two segments disposed or originating at mutually opposite ends of one diameter of the housing. In this way, machining is simpler, because the penetration depth when machining the line into the tube plate is virtually halved. Nevertheless, the advantages of the invention, namely the use of the already existing tube plate to form a blow-down line, which functions in a vibration-proof manner and is free of thermal strains, are retained to their full extent.

In accordance with a further feature of the invention, the vertical bores have spacings therebetween, and the spacings have decreasing sizes as seen from the periphery toward the middle of the housing. This is done so that in the vicinity of the middle of the tube bundle in which there is little flow, a particularly intensive blow-down effect is present.

In accordance with an added feature of the invention, the spacings include a smallest and a largest spacing, and the smallest spacing is at most one-half of the largest spacing. This a clear distinction as compared with the partial lines described in German Published, Prosecuted Application DE-AS 25 23 874, in which the flow cross sections decrease considerably toward the middle of the steam generator.

In accordance with an additional feature of the invention, there is provided a cylindrical jacket enclosing the tube bundle and defining an annular chamber between the housing and the cylindrical jacket, the tube plate having further horizontal blow-down bores formed therein beneath the annular chamber and the tube plate having a vertical bore formed therein leading from the further horizontal blow-down bores into the annular chamber. This prevents accumulations of corrosion-promoting deposits in the annular chamber, which is otherwise not reached by the cleaning process.

In accordance with a concomitant feature of the invention, there is provided a common blow-down collector connected to the blow-down bores and the blow-down line.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

Figure 2:
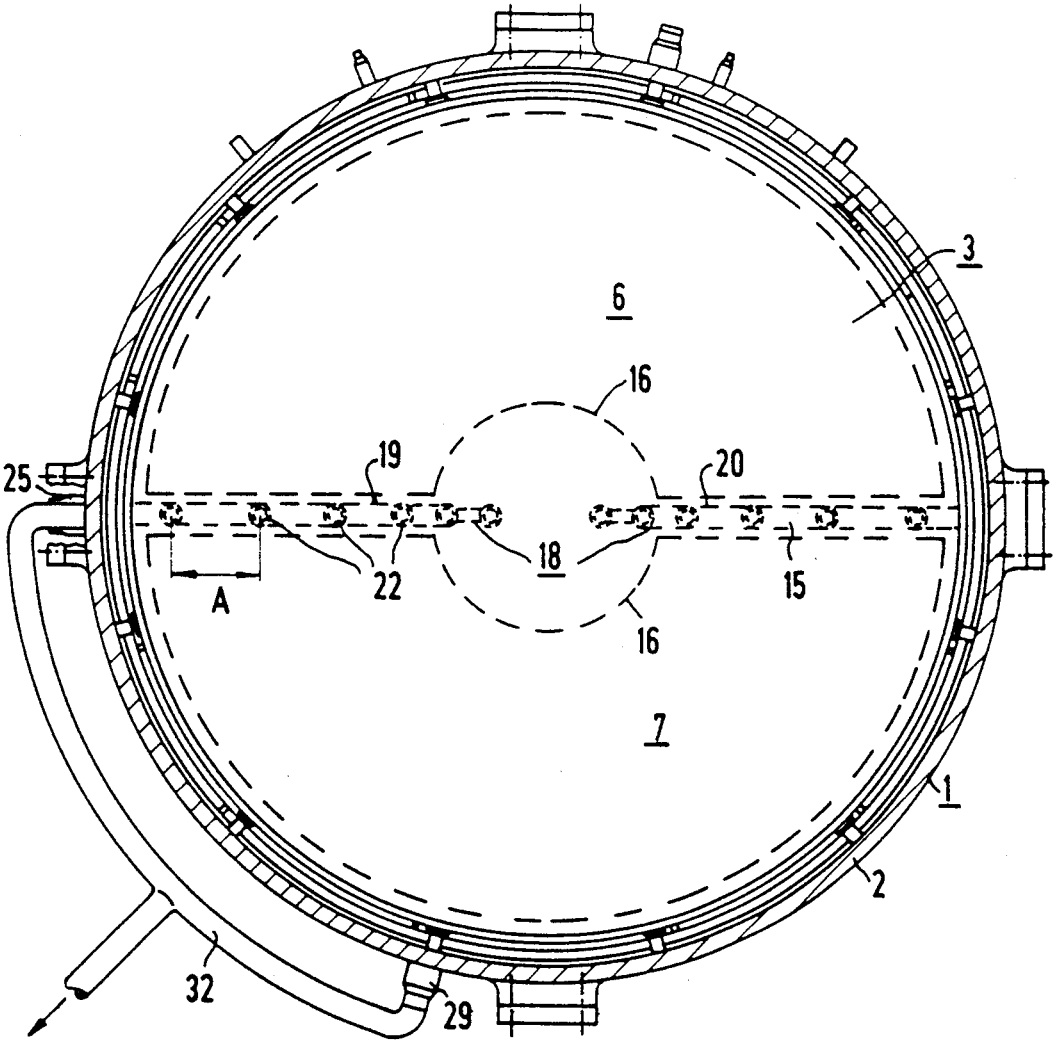

The construction and method of operation of the invention, however, together with additional objects and advantages thereof will be best understood from the following description of specific embodiments when read in connection with the accompanying drawings, in which:

FIG. 1 is a fragmentary, diagrammatic, vertical-sectional view showing the bottom region of a U-shaped tube steam generator for a pressurized water reactor, and FIG. 2 is a horizontal-sectional view of the device shown in FIG. 1, as seen in the direction toward the tube plate or sheet.

Referring now to the figures of the drawing in detail and first, particularly, to FIG. 1 thereof, there is seen a steam generator which includes a housing 1 that is elongated in the vertical direction and encloses a U-shaped tube bundle or nest 3 with a cylindrical wall 2. Tube ends 5 of legs 6 and 7 of the tube bundle 3 are set in a tube plate or sheet 8, which divides the cylindrical housing 1 in a horizontal plane. Beneath the tube plate or sheet 8, the steam generator housing 1 is closed off with a spherical bottom 10, in which two chambers 11 and 12 are provided in order to subject the tube bundle 3 to the primary water of the pressurized water reactor.

FIG. 2 shows that the legs 6 and 7 of the tube bundle 3 are adapted to the cylindrical cross section of the steam generator housing 1. This produces a tube lane 15 between the two legs 6 and 7, which is circularly widened in the center of the steam generator. The boundaries of the cross section of the tube bundle 3 are shown in FIG. 2 with a broken line 16.

The tube plate 8 has a thickness of 500 mm, for example. A blow-down line 18 in the form of a bore having two segments 19 and 20, is formed in the middle of the tube plate 8, or in other words with portions of the tube plate spaced uniformly above and below it. As FIG. 2 shows, the segments 19 and 20 are located on one diameter, so that vertical bores 22, which connect the segments 19 and 20 to the space located above the tube plate 8, lead into the tube lane 15 between the two legs 6 and 7 of the tube bundle 3. A spacing A between the bores 22 decreases more and more as seen from the edge inward. In the vicinity of a circular enlargement 16, the spacing A amounts to only one-third of the spacing A between the two outermost bores.

The segments 19 and 20 lead to tube fittings 25, which are welded onto the steam generator housing 1. As shown at the right-hand side of FIG. 1, short horizontal bores 26 also discharge from that location, and a vertical connection bore 27 leads from the horizontal bores 26 into an annular chamber 28 between the housing wall 2 and a cylindrical jacket 30 surrounding the tube bundle 3. Connection fittings 29 of the horizontal blow-down bores 26 and the segments 19 and 20 are connected to a common blow-down collecting line 32, as indicated in FIG. 2.

The foregoing is a description corresponding in substance to German Application P 37 38 347.7, dated Nov. 11, 1987, the International priority of which is being claimed for the instant application, and which is hereby made part of this application. Any material discrepancies between the foregoing specification and the aforementioned corresponding German application are to be resolved in favor of the latter.

I claim:

1. Steam generator, comprising a vertically elongated housing, a horizontal tube plate in said housing, and a U-shaped tube bundle in said housing, said tube bundle having mutually spaced apart legs defining an intermediate space therebetween and tube ends disposed in said tube plate, said tube plate having a horizontal blow-down line formed therein and said tube plate having holes formed therein leading from said blow-down line into said intermediate space.

2. Steam generator according to claim 1, wherein said horizontal blow-down line includes two segments disposed at mutually opposite ends of one diameter of said housing.

3. Steam generator according to claim 1, wherein said holes have spacings therebetween, and said spacings have decreasing sizes as seen from the periphery toward the middle of said housing.

4. Steam generator according to claim 3, wherein said spacings include a smallest and a largest spacing, and said smallest spacing is at most one-half of said largest spacing.

5. Steam generator according to claim 1, including a cylindrical jacket enclosing said tube bundle and defining an annular chamber between said housing and said cylindrical jacket, said tube plate having a horizontal blow-down hole formed therein beneath said annular chamber and said tube plate having a hole formed therein leading from said further horizontal blow-down hole into said annular chamber.

6. Steam generator according to claim 5, including a common blow-down collector connected to said blow-down hole and said blow-down line.

* * * * *